US008834598B2

(12) United States Patent
Berni et al.

(10) Patent No.: US 8,834,598 B2
(45) Date of Patent: Sep. 16, 2014

(54) PROCESS TO PRODUCE ROUGH FERRO-NICKEL PRODUCT

(75) Inventors: Tiago V. Berni, Belo Horizonte (BR); Antonio C. Pereira, Belo Horizone (BR)

(73) Assignee: Vale S.A., Rio de Janeiro (BR)

( * ) Notice: Subject to any disclaimer, the term of this patent is extended or adjusted under 35 U.S.C. 154(b) by 286 days.

(21) Appl. No.: 13/367,087

(22) Filed: Feb. 6, 2012

(65) Prior Publication Data

US 2012/0198967 A1 Aug. 9, 2012

Related U.S. Application Data

(60) Provisional application No. 61/439,448, filed on Feb. 4, 2011.

(51) Int. Cl.
*C22B 5/00* (2006.01)
*C22B 23/02* (2006.01)

(52) U.S. Cl.
CPC ..... *C22B 23/023* (2013.01)
USPC ..... 75/392; 75/629

(58) Field of Classification Search
CPC ..... C22B 23/023; C22B 33/0235; C22C 5/02
USPC ..... 420/590; 75/392, 629
See application file for complete search history.

(56) References Cited

U.S. PATENT DOCUMENTS 7,597,738 B2 * 10/2009 Liu et al. ..... 75/416
2012/0198965 A1 * 8/2012 Lee ..... 75/300

FOREIGN PATENT DOCUMENTS

WO WO 2009100495 A1 * 8/2009 ..... C22B 5/10

* cited by examiner

*Primary Examiner* — George Wyszomierski
*Assistant Examiner* — Tima M McGuthry Banks
(74) *Attorney, Agent, or Firm* — Arent Fox LLP

(57) ABSTRACT

Aspects of the present invention refer to a MHP process do produce rough ferro-nickel product and that may include the steps of mixing nickel hydroxide with an iron source and slagging agents, putting the mixture in contact with a reducing agent producing a ferronickel alloy, and producing a roasted product that has disseminated ferronickel alloy inside the structure.

9 Claims, No Drawings

PROCESS TO PRODUCE ROUGH FERRO-NICKEL PRODUCT

Aspects of the present invention refer to a MHP process do produce rough ferro-nickel product.

CROSS-REFERENCE TO RELATED APPLICATION

This Application is based upon U.S. Provisional Application No. 61/439,448, having a filing date of Feb. 4, 2011, entitled Process to Produce Rough Ferro-Nickel Product, and the disclosure of which is hereby incorporated in its entirety by reference.

BACKGROUND OF THE INVENTION

Nickel electro-winning is generally an expensive process and may not be available for any existing nickel deposits, particularly small deposits or low grade deposits. The alternatives are, among others, producing intermediate products like MSP (nickel/cobalt Mixed Sulphide Precipitation) or MHP (Ni/Co Mixed Hydroxide Precipitation). While the first process has a good market, the production of $H_2S$ or NaHS is expensive and generally not trivial. The second process is easy to operate but has a generally restricted market.

SUMMARY OF THE INVENTION

Aspects of the current invention refer to a process to produce rough Ferro-Nickel products including the steps of mixing nickel hydroxide with an iron source and slagging agents, putting the mixture in contact with a reducing agent producing a ferronickel alloy, and producing a roasted product that has disseminated ferronickel alloy inside the structure.

The iron source is preferably iron ore or metallic agent, the slagging agent is preferably one or more selected from the group consisting of MgO, $SiO_2$, $CaCO_3$, $CaF_2$ and CaO, the reducing agent is preferably selected from the group consisting of carbon, natural gas or hydrogen.

In various aspects of the current invention, the total amount of slagging agent is between 5 and 500% of the ferronickel mass, and more preferably between 10% and 30%. According to various aspects, the reducing agent may be selected from the group consisting of carbon, natural gas or hydrogen, and the amount of reducing agent is between 50 and 500% the stoichiometric amount for producing metallic ferronickel.

The step of producing a roasted product may be performed in a furnace with a temperature ranging from 500° C. to 2000° C., preferably between 700° C. and 1200° C., with a residence time of approximately 6 hours.

DETAILED DESCRIPTION OF THE INVENTION

According to various aspects of the current invention, after removing cobalt from nickel from MHP or from any other nickel and cobalt source, a final pure nickel hydroxide precipitate may be formed (this precipitate may also contain iron hydroxides). That nickel hydroxide may be mixed with an iron source as iron ore or metallic iron and slagging agents such as, but not limited to MgO, $SiO_2$, $CaCO_3$, $CaF_2$ and/or CaO. The amount of nickel and iron added may depend on the ferronickel desired, ranging from 1 to 99% nickel (99 to 1% iron). According to various aspects, a ferronickel in the range of 20% and 60% nickel may be used. The slagging agent used may depend on local availability and on the final ferronickel process, but the total amount of slagging agent may vary from 5 to 500% of the ferronickel mass, or between 10 and 30%.

Putting this mixture in contact with a reducing agent such as, but not limited to, carbon, natural gas or hydrogen, a ferronickel alloy may be produced. The amount of reducing agent may depend on the amount of iron and nickel, as well as the form of iron (metallic or oxide). According to various aspects, the amount of reducing agent used may be between 50 to 500% the stoichiometric amount for producing metallic ferronickel.

According to various aspects, the furnace is kept in a temperature high enough to produce the alloy, but enough to melt the slag or the alloy, producing a roasted product that has disseminated ferronickel alloy inside the structure. Temperatures ranging from 500 to 2000° C. are known to work, and also between 700 to 1200° C. Residence time may be as much as 12 hours, but up to 6 hours is also possible. This intermediate product can be sent to a ferronickel furnace for final processing. According to various aspects, if the ferronickel produced is magnetic, then this structure may be be grinded and the ferronickel can be separated using magnetic field.

This final product may be used in a ferronickel furnace for further processing, sent to a blast furnace reactor or any other application known by those skilled in the art.

According to various aspects, some advantages of the present process include:

Production of a cheap, easy to handle and transport, intermediate nickel product (Rough FerroNickel, or Rofeni);

Increase ferronickel furnace production by adding a high ferronickel raw material;

Increase synergies with other areas of production;

Reduces costs of downstream processing of nickel;

Exploit low-grade or small nickel deposits.

The invention claimed is:

1. A process to produce rough Ferro-Nickel product, comprising the steps of:

(i) mixing nickel hydroxide with an iron source and slagging agents to produce a mixture, wherein the iron source comprises iron ore or metallic agent;

(ii) contacting the mixture with a reducing agent to produce a ferronickel alloy; and (iii) producing a roasted product that has disseminated ferronickel alloy inside the structure thereof.

2. The process according to claim 1, wherein the slagging agents are selected from the group consisting of MgO, $SiO_2$, $CaCO_3$, $CaF_2$ and CaO.

3. The process according to claim 2, wherein a total amount of slagging agents is between 5 and 500% of ferronickel mass.

4. The process according to claim 3, wherein the total amount of slagging agents is between 10% and 30% of the ferronickel mass.

5. The process according to claim 1, wherein the reducing agent is selected from the group consisting of carbon, natural gas and hydrogen.

6. The process according to claim 5, wherein the amount of reducing agent is between 50 and 500% of a stoichiometric amount for producing metallic ferronickel.

7. The process according to claim 1, wherein the step of producing a roasted product is performed in a furnace at a temperature ranging from 500 to 2000° C.

8. The process according to claim 7, wherein a residence time is approximately 6 hours.

9. A process to produce rough Ferro-Nickel product, comprising the steps of:

(i) mixing nickel hydroxide with an iron source and slagging agents to produce a mixture;

(ii) contacting the mixture with a reducing agent to produce a ferronickel alloy; and (iii) producing a roasted product that has disseminated ferronickel alloy inside the structure thereof, wherein producing a roasted product is performed in a furnace at a temperature ranging from 700° C. and 1200° C.

* * * * *